United States Patent [19]

Tamplen

[11] Patent Number: 4,473,122

[45] Date of Patent: Sep. 25, 1984

[54] DOWNHOLE SAFETY SYSTEM FOR USE WHILE SERVICING WELLS

[75] Inventor: Jack W. Tamplen, Celina, Tex.

[73] Assignee: Otis Engineering Corporation, Dallas, Tex.

[21] Appl. No.: 561,468

[22] Filed: Dec. 14, 1983

Related U.S. Application Data

[63] Continuation of Ser. No. 376,021, May 7, 1982, abandoned.

[51] Int. Cl.[3] ..... E21B 43/12; E21B 34/10

[52] U.S. Cl. ..... 166/373; 166/381; 166/322; 166/334

[58] Field of Search ..... 166/373-375, 166/369, 381, 386, 387, 319-322, 332, 334, 80, 84, 87, 77, 72, 73

[56] References Cited

U.S. PATENT DOCUMENTS

| | | | |
|---|---|---|---|
| 2,831,539 | 4/1958 | En Dean et al. | 166/73 |
| 3,157,233 | 11/1964 | Sizer et al. | 166/102 |
| 3,208,531 | 9/1965 | Tamplen | 166/125 |
| 3,215,203 | 11/1965 | Sizer | 166/77 |
| 3,216,731 | 11/1965 | Dollison | 277/1 |
| 3,280,914 | 10/1966 | Sizer et al. | 166/72 |
| 3,874,634 | 4/1975 | Gazda | 251/319 |
| 3,967,678 | 7/1976 | Blackwell | 166/84 |
| 4,134,454 | 1/1979 | Taylor | 166/320 |
| 4,345,766 | 8/1982 | Taranyi | 166/84 |
| 4,420,043 | 12/1983 | Brooks | 166/319 |

*Primary Examiner*—James A. Leppink
*Assistant Examiner*—Hoang C. Dang
*Attorney, Agent, or Firm*—Thomas R. Felger

[57] ABSTRACT

A safety valve which prevents undesired fluid flow while conducting hydraulic workover or snubbing operations on a well. The safety valve includes three separate valve portions for blocking fluid flow. A poppet valve can be opened and closed from the well surface. Elastomeric sealing elements form a fluid barrier with the exterior of the work string. The work string itself opens and closes a flapper valve. The poppet valve allows fluid flow to bypass the elastomeric sealing elements.

14 Claims, 16 Drawing Figures

DOWNHOLE SAFETY SYSTEM FOR USE WHILE SERVICING WELLS

This application is a continuation of application Ser. No. 376,021 filed May 7, 1982 now abandoned.

BACKGROUND OF THE INVENTION

1. Field of the Invention

This information relates to downhole well tools and methods for preventing undesired release of well fluids while servicing wells.

2. Description of the Prior Art

U.S. Pat. No. 3,215,203 to P. S. Sizer discloses equipment and methods for inserting and removing a flow conductor from a well. U.S. Pat. No. 3,216,731 discloses well tools and methods for preventing a blowout while moving a flow conductor into and out of a well. Both of these patents are incorporated by reference for all purposes within this application. They both disclose equipment and methods which are used for hydraulic workover of oil and gas wells. This equipment is sometimes referred to as "snubbing" equipment because a flow conductor (work string or wash string of pipe) is inserted into the well against formation fluid pressure rather than overcoming the formation pressure with drilling mud or workover fluids.

SUMMARY OF THE INVENTION

This invention discloses a safety valve for controlling fluid flow through a first flow conductor, comprising housing means with a longitudinal flow passageway extending therethrough; a valve closure means having a first position allowing fluid flow through the first flow conductor and a second position blocking fluid flow through the first flow conductor; means for shifting the valve closure means between its first position and its second position in response to control fluid pressure from the well surface; and sealing means for forming a fluid barrier with the exterior of a second flow conductor when the second flow conductor is disposed within the longitudinal flow passageway.

An object of the present invention is to provide a safety valve which can control the flow of well fluids through a production tubing string.

Another object of the present invention is to provide a downhole safety valve which allows a work string to be inserted through the safety valve while the safety valve continues to control well fluid flow.

A further object of the present invention is to provide a downhole safety valve which can be releasably secured within a production tubing string. The safety valve contains elastomeric sealing means to engage the exterior of a work string which can be inserted through the safety valve.

A still further object of the invention is to provide a safety valve or downhole blowout preventer which can control fluid flow in the annulus created by inserting a work string into the bore of a production tubing string.

Another object of the present invention is to provide a safety valve or downhole blowout preventer which will block fluid flow through a production tubing string after a work string has been withdrawn from the tubing string.

An additional object of the present invention is to provide a downhole blowout preventer to prevent the undesired escape of well fluids while moving a work string through the bore of a production tubing string.

A further object of the present invention is to provide a downhole safety valve which has a valve closure means that can be mechanically opened by inserting a work string through the safety valve and will automatically close when the work string is withdrawn from the safety valve.

A further object of the present invention is to provide a method for preventing undesired fluid flow while servicing or working over a well which has not been killed by drilling mud or workover fluids.

A still further object of the present invention is to provide a safety valve which can form a fluid barrier with the exterior of a work string but will still allow fluid flow in the annulus between the work string and production tubing string.

Additional objects and advantages of the present invention will be readily apparent to those skilled in the art from reading the following description in conjunction with the drawings and claims.

DESCRIPTION OF THE PREFERRED EMBODIMENT

Figure 1A:
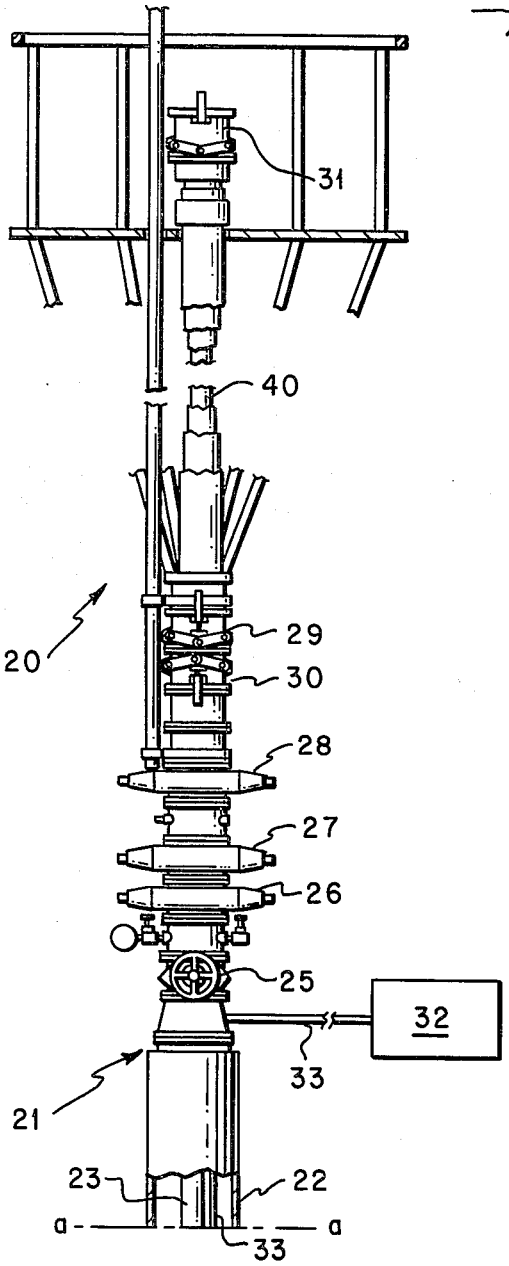
FIG. 1A is a drawing, partially in vertical section and partially in elevation with portions broken away, showing a typical well with the lower portion of a hydraulic snubbing apparatus (hydraulic workover unit) mounted on the wellhead.
Figure 1B:
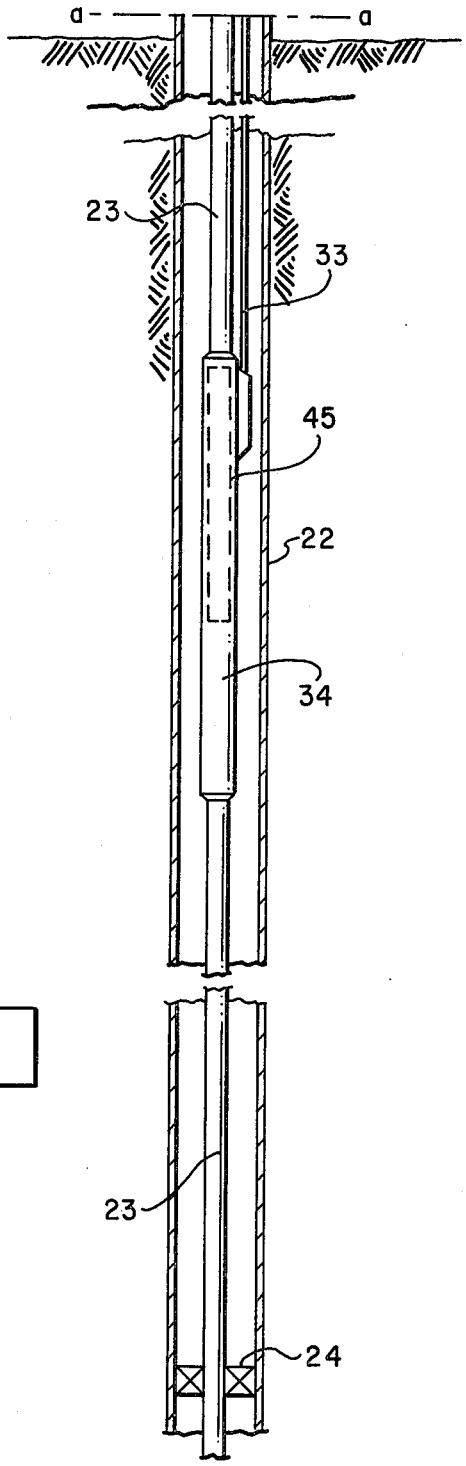
FIG. 1B is a continuation of the well shown in FIG. 1A including a schematic representation of the downhole safety system to prevent undesired fluid flow while working over the well.
Figures 2A, 2B:
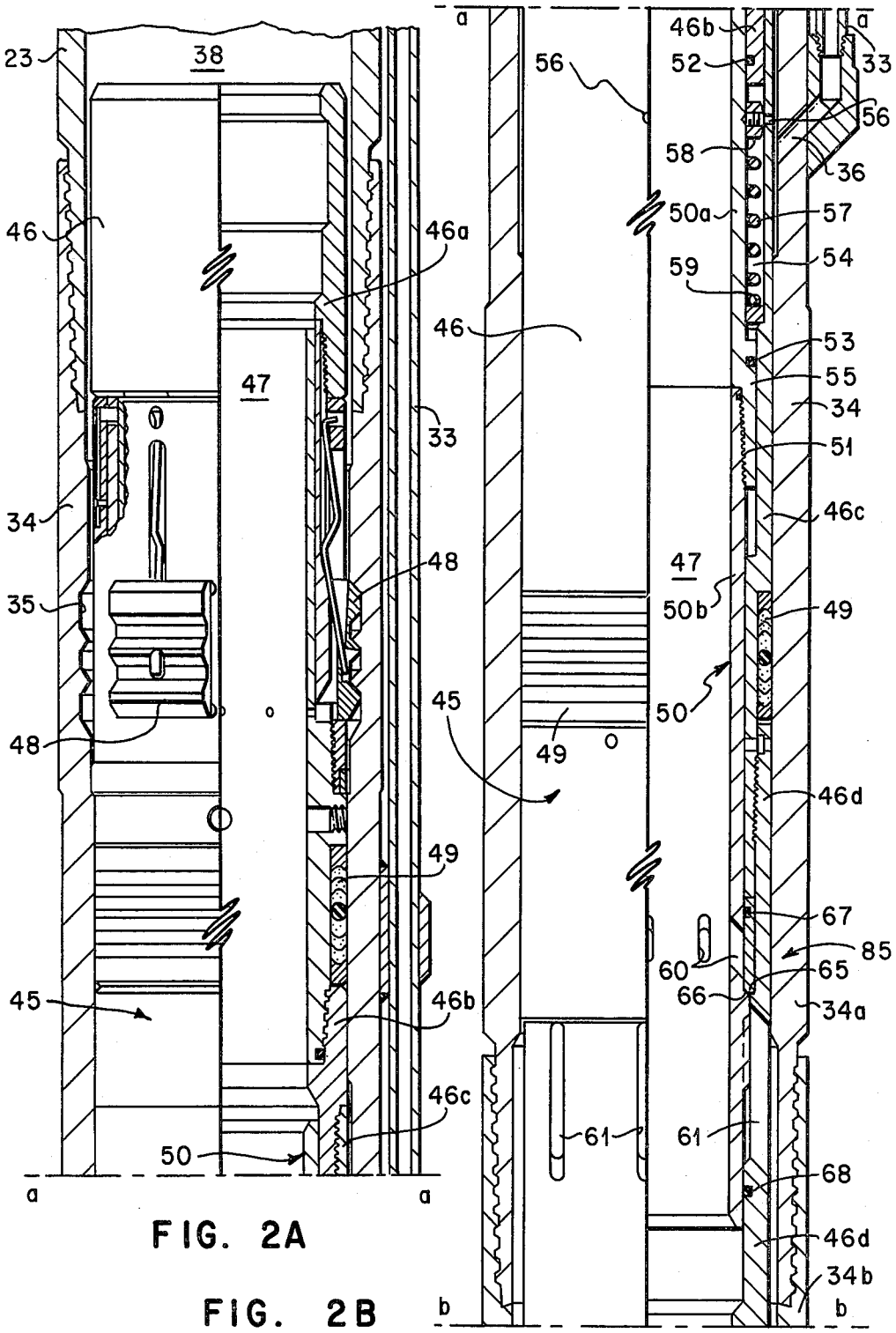
FIGS. 2A–D are drawings partially in elevation and partially in section showing a safety valve incorporating the present invention in its second position blocking fluid flow through the production tubing string (first flow conductor).
Figure 2C:
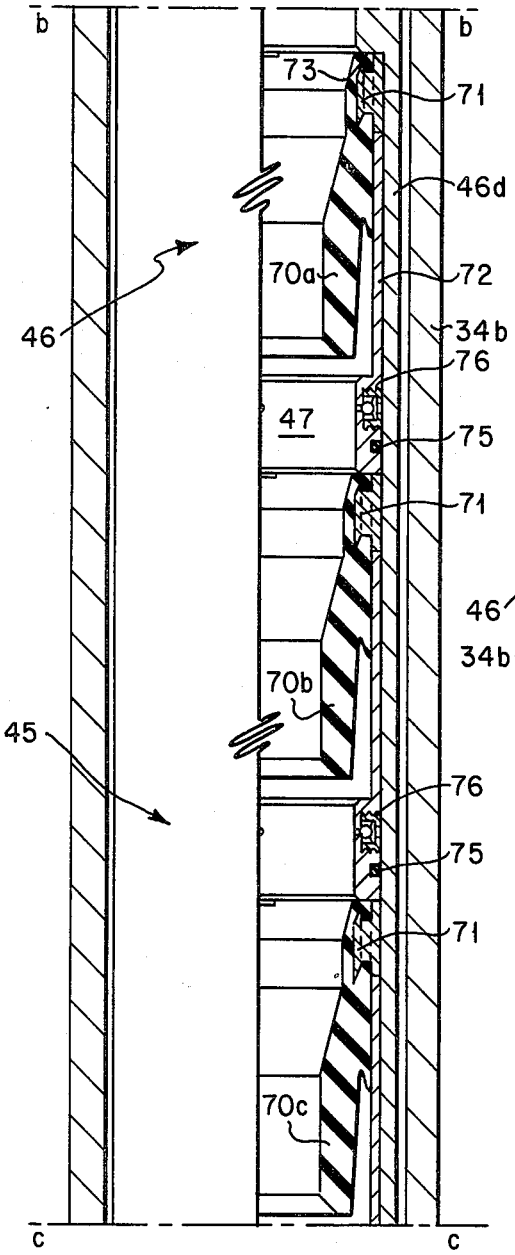
Figure 2D:
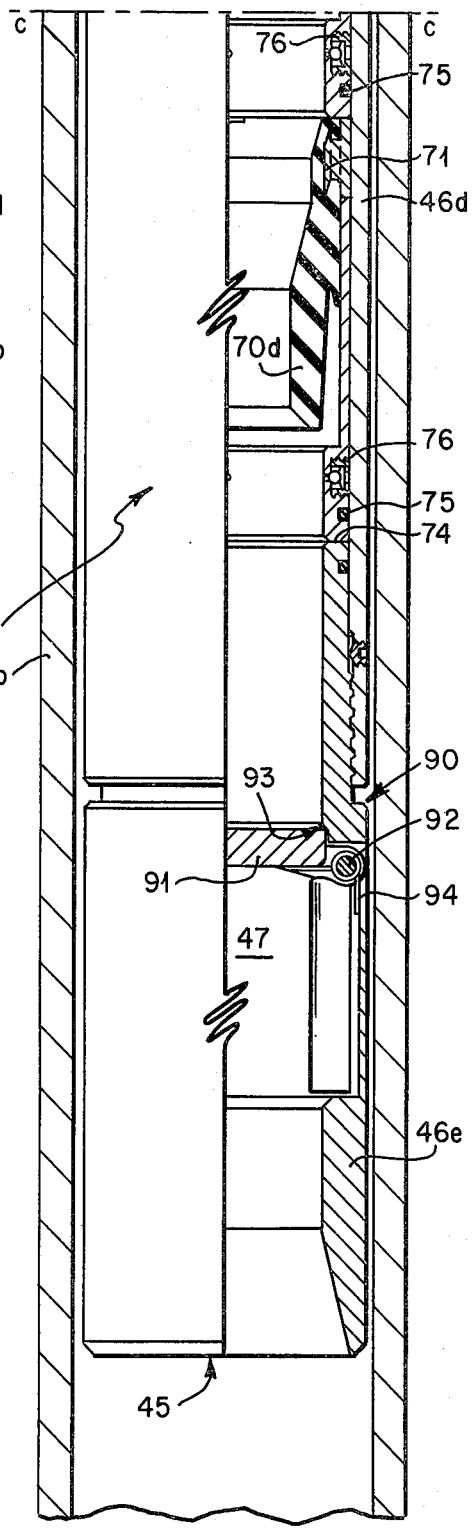

Reffering to FIGS. 1A and 1B, hydraulic snubbing apparatus 20 is shown mounted on wellhead 21. The well is partially defined by casing string 22 which extends from the well surface to a subterranean hydrocarbon producing formation (not shown). Wellhead 21 is attached to and supported by casing string 22.

Production tubing string or first flow conductor 23 is disposed within the bore of casing string 22. Well packer 24 is installed at a downhole location to form a fluid barrier between the exterior of tubing 23 and the interior of casing 22. Packer 24 directs fluid communication between the hydrocarbon producing formation and wellhead 21 via bore 38 of tubing 23. Packer 24 is preferably positioned to isolate most of the interior of casing 22 from the corrosive effects of formation fluids. This system of completing a well allows for reduced maintenance and increased well life. Only production tubing string 23 should have to be cleaned and/or replaced. Casing 22 should last indefinitely if not subjected to corrosive fluids.

Wellhead 21 includes master valve 25 which controls flow into and out of tubing 23. Three sets of blowout preventers 26, 27, and 28 are mounted onto wellhead 21 above master valve 25 during hyudraulic workover of the well. Blowout preventers 26, 27, and 28 are of a conventional type. They are operated by fluid pressure and have a vertical bore aligned with bore 38 of tubing 23. The preventers are used to retain pressure within tubing 23 while work string or second flow conductor 40 is moved longitudinally therethrough.

Hydraulic snubbing apparatus 20 includes the necessary stationary slip assemblies 29 and 30 and traveling slip assembly 31 to move work string or wash pipe 40 longitudinally into or out of the bore of tubing 23. A detailed description of hydraulic snubbing apparatus 20 and associated methods for servicing a well are contained in U.S. Pat. No. 3,215,203. This description of the invention is made with reference to using snubbing apparatus 20 to move work string 40 through safety valve 45. A similar safety valve, incorporating the present invention, could be installed within casing string 22 and production tubing string 23 moved longitudinally therethrough by snubbing apparatus 20. Also, a coiled tubing unit or reeled tubing injector (not shown) could be used to insert a second flow conductor into bore 38 of tubing 23.

Control manifold 32 at the well surface contains the necessary accumulators, pumps, and valves to supply hydraulic control fluid to safety valve 45 via control line 33. Safety valve 45 contains three separate means for preventing the undesired flow of well fluids. Each of these means will be described in detail. They cooperate to allow safety valve 45 to function as a downhole blowout preventer while moving second flow conductor 40 through bore 38 of first flow conductor 23.

Referring to FIGS. 2A–D, safety valve 45 is shown in its second position blocking fluid flow through tubing 23. Safety valve 45 includes housing means 46 with longitudinal flow passageway 47 extending therethrough. For ease of manufacture and assembly, housing means 46 consists of several relatively long, hollow cylindrical subassemblies. They are attached to each other by threaded connections and are concentrically aligned to define longitudinal flow passageway 47. Housing means subassembly **46*a* is a conventional locking mandrel used for releasably anchoring safety valve 45 at a downhole location within tubing 23. Landing nipple 34 is made up as a part of tubing string or first flow conductor 23. Grooves 35 are formed on the interior of landing nipple 34 to receive dogs 48 of locking mandrel or housing subassembly 46*a*. Two sets of packing means 49 are carried on the exterior of locking mandrel 46*a* to form a fluid barrier between the exterior of locking mandrel 46*a* and the interior of landing nipple 34. Packing means 49 restrict fluid flow through safety valve 45 to longitudinal flow passageway 47. The two sets of packing means 49 are spaced longitudinally from each other to provide a fluid seal on opposite sides of port 36 which extends through landing nipple 34. Port 36 allows control fluid to communicate between control line 33 and the interior of landing nipple 34. Packing means 49** isolate control fluid from formation fluids.

U.S. Pat. No. 3,208,531 to Jack W. Tamplen fully discloses a locking mandrel and landing nipple satisfactory for use with the present invention. If desired, the present invention could be incorporated into a safety valve which is permanently attached to and made up as a part of tubing string 23. However, such an arrangement might unduly restrict production fluid flow. Therefore, safety valve 45 is preferably installed by conventional wireline techniques just prior to servicing the well and is removed after completion of the services.

Operating sleeve 50 is slidably disposed within longitudinal flow passageway 47. For ease of assembly, operating sleeve 50 comprises two hollow cylindrical subassemblies **50*a* and 50*b* which are joined together by threads 51. Operating sleeve subassembly 50*a* is disposed within and concentrically aligned with housing means subassembly 46*c*. Subassembly 46*c* functions as a pistion housing. Adapter subassembly 46*b* connects piston housing 46*c* to locking mandrel 46*a***.

Stationary seal 52 is carried on the inside diameter of adapter subassembly **46*b* to form a fluid barrier with the adjacent outside diameter portion of operating sleeve 50. Movable piston seal 53 is carried on the outside diameter of operating sleeve 50 and contacts the adjacent inside diameter portion of piston housing 46*c*. Seals 52 and 53 are spaced longitudinally from each other and partially define variable volume control fluid chamber 54. The difference in diameter between stationary seal 52 and movable piston seal 53 defines the effected area for piston 55 on the exterior of operating sleeve 50. Ports 56 extend laterally through the wall of piston housing 46*c* to allow control fluid communications with variable volume chamber 54**.

Biasing means or spring 57 is disposed within chamber 54 surrounding the exterior of operating sleeve 50. Biasing means 57 is positioned between shoulder 58 carried on the exterior of operating sleeve 50 and shoulder 59 carried on the interior of piston housing **46*c*. Increasing the pressure of control fluid within chamber 54 to a value greater than fluid pressure within longitudinal flow passageway 47 creates a force on piston 55 which tends to slide operating sleeve 50 longitudinally in one direction. Biasing means or spring 57 resists this movement. When the difference in fluid pressure between chamber 54 and passageway 47 decreases below a preselected value, spring 57 will return operating sleeve 50** to its initial position.

Figure 3A:
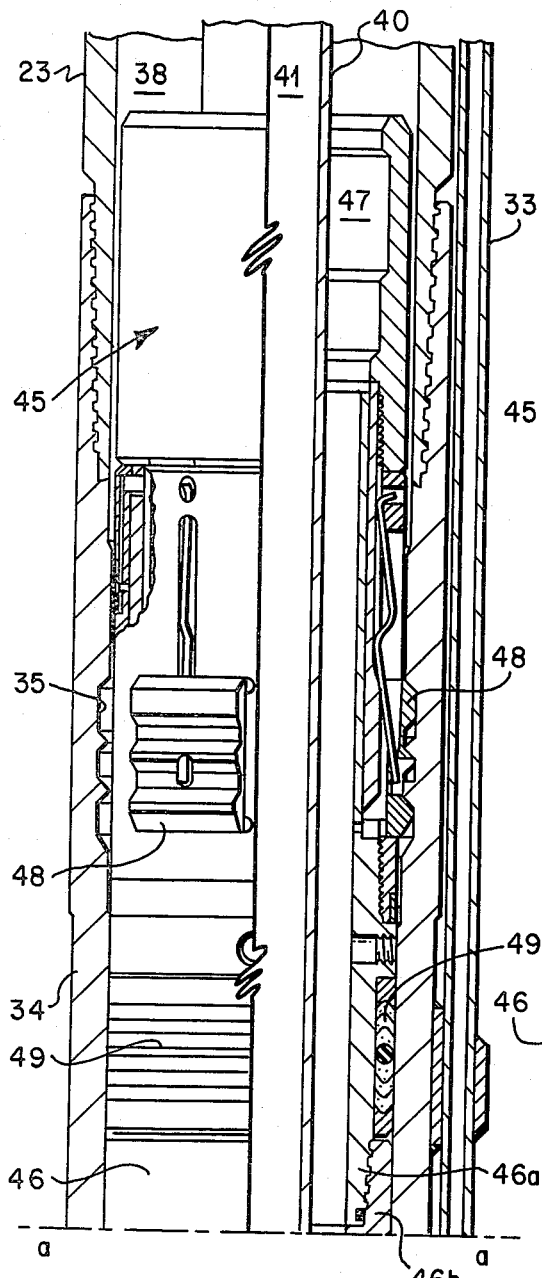
FIGS. 3A–D are drawings partially in section and partially in elevation showing the safety valve of FIGS. 2A–D in its first position with a work string (second flow conductor) inserted therethrough and the poppet valve means open to allow fluid flow through the annulus between the work string and the production tubing string.
Figure 3B:
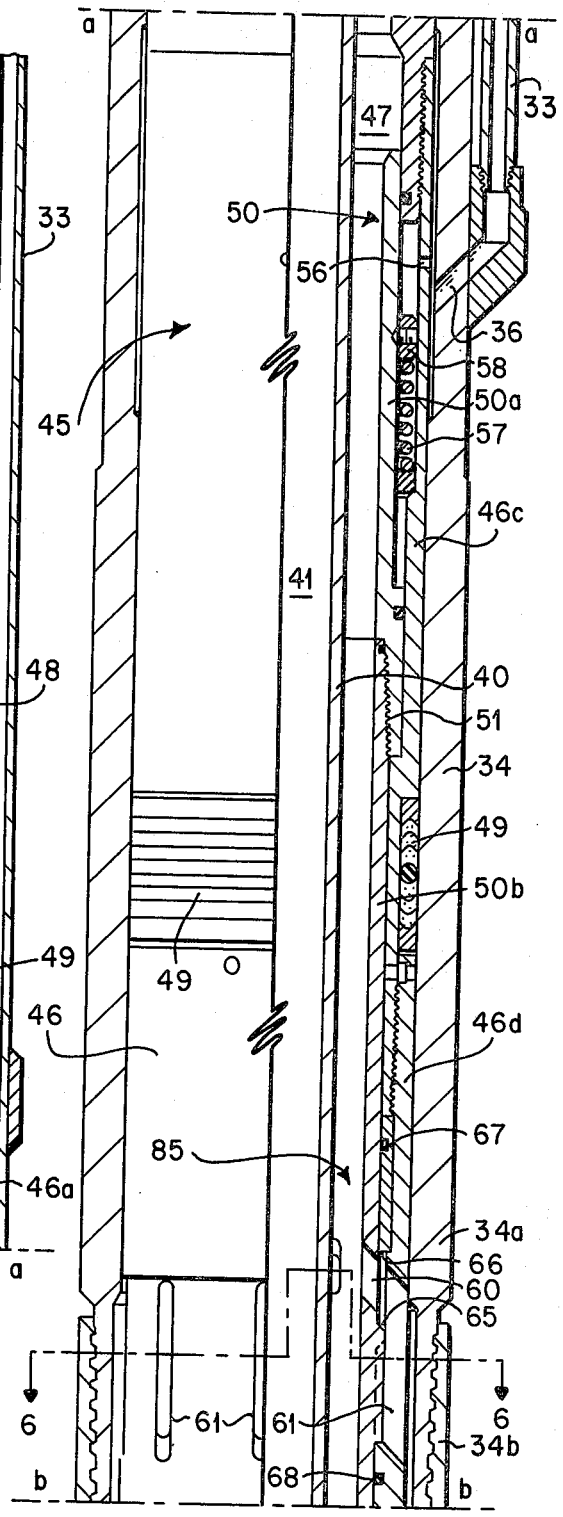
Figure 6:
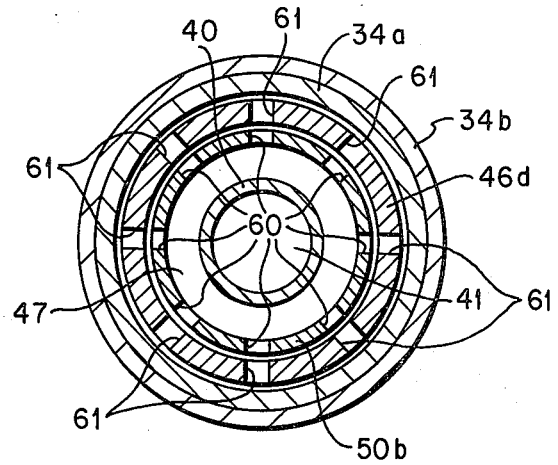
FIG. 6 is a cross-sectional view taken along line 6—6 of FIG. 3B and shows the poppet valve means in its open position.

Operating sleeve 50 is used to open and close poppet valve means 85 of safety valve 45 in response to control fluid pressure within chamber 54. The poppet valve means includes operating sleeve subassembly **50*b* and housing means subassembly 46*d*. A plurality of radial openings 60 extends through operating sleeve subassembly 50*b* intermediate the ends thereof. A plurality of longitudinal slots or radial openings 61 is machined through the exterior of housing subassembly 46*d*. When radial openings 60 are positioned adjacent to longitudinal slots 61, fluids can communicate between passageway 47 and the exterior of housing means 46** as shown in FIGS. 3B and 6.

First annular valve seat 65 is formed on the exterior of operating sleeve 50 adjacent to radial openings 60.

Second annular valve seat 66 is formed on the interior of housing means 46 adjacent to radial openings 61 and facing first annular valve seat 65. Annular valve seats 65 and 66 are sized to engage each other and function as a poppet type valve.

Stationary elastomeric seals 67 and 68 are carried on the interior of housing means 46 to form a fluid barrier with the exterior portion of operating sleeve 50 adjacent thereto. Seals 67 and 68 have equal diameters to prevent differences in fluid pressure from acting upon operating sleeve 50. Seals 67 and 68 are spaced longitudinally from each other on opposite sides of radial openings 60 and 61. Therefore, when first annular seat 65 contacts second annular seat 66, this contact in cooperation with seals 67 and 68 blocks fluid communication through radial openings 60 and 61.

A plurality of sealing elements 70*a–d* is disposed within longitudinal flow passageway 47 surrounded by housing means subassembly 46*d*. Sealing elements 70*a–d* comprise sealing means for forming a fluid barrier with the exterior of work string 40 when it is disposed within longitudinal flow passageway 47. Sealing elements 70*a–d* are molded from suitable elastomeric material and are secured to their respective flange 71. Each flange 71 projects radially inward from its respective retaining cylinder 72. Retaining cylinders 72 are slidably disposed within housing means subassembly 46*d* between shoulders 73 and 74. The number of sealing elements can be varied to correspond with well fluid pressure.

Figure 3C:
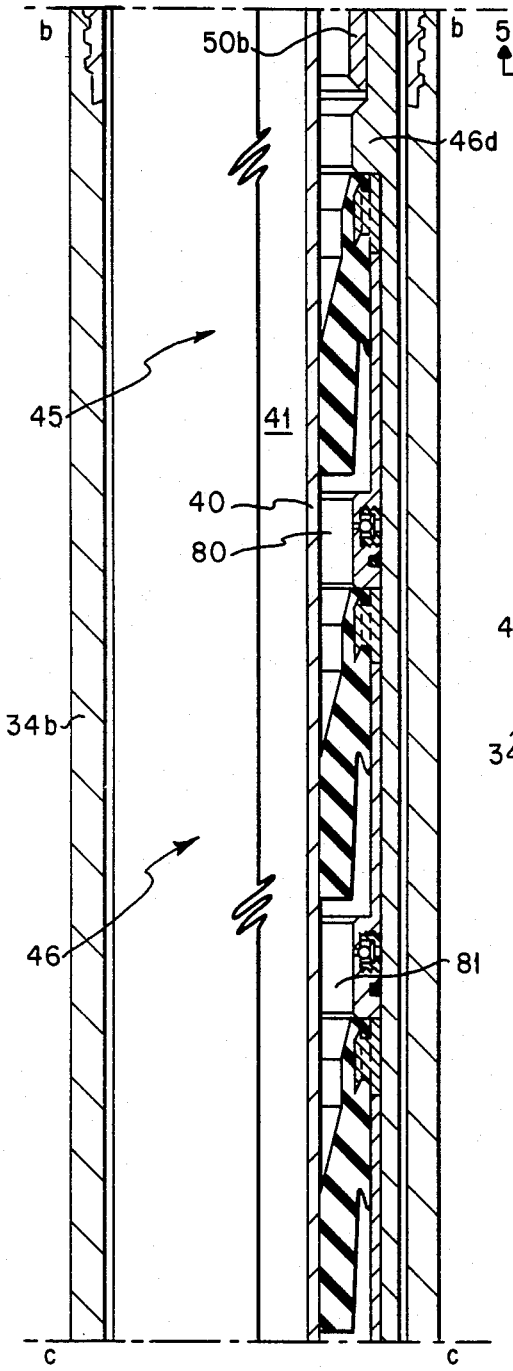
Figure 3D:
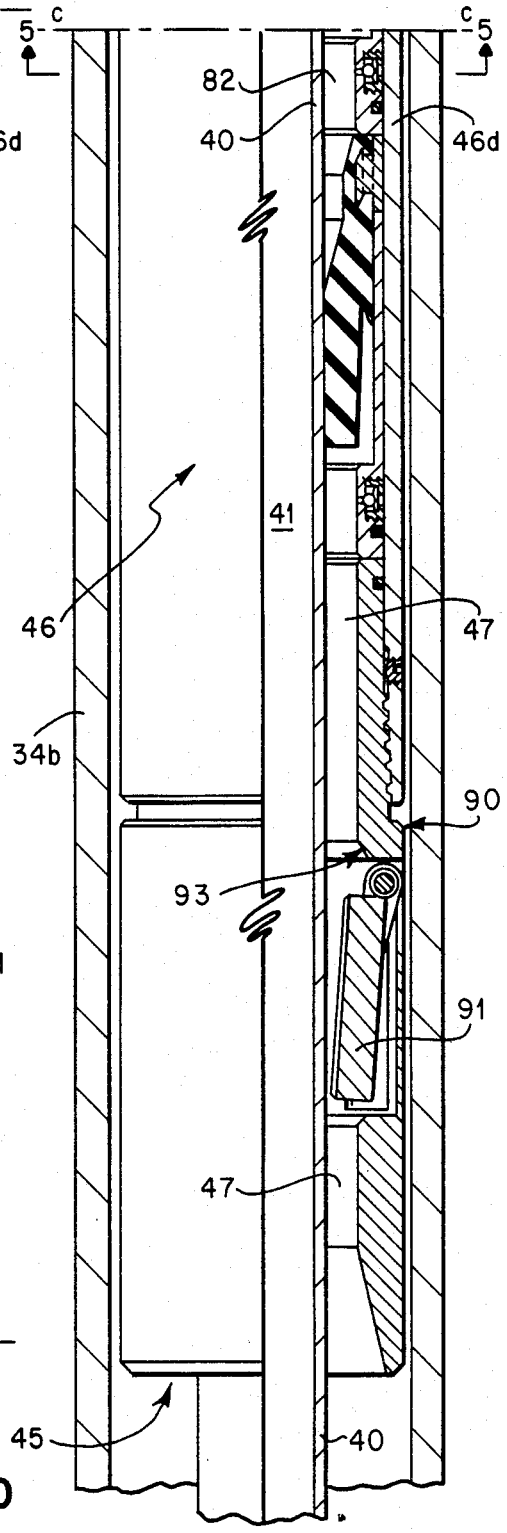
Figure 4A:
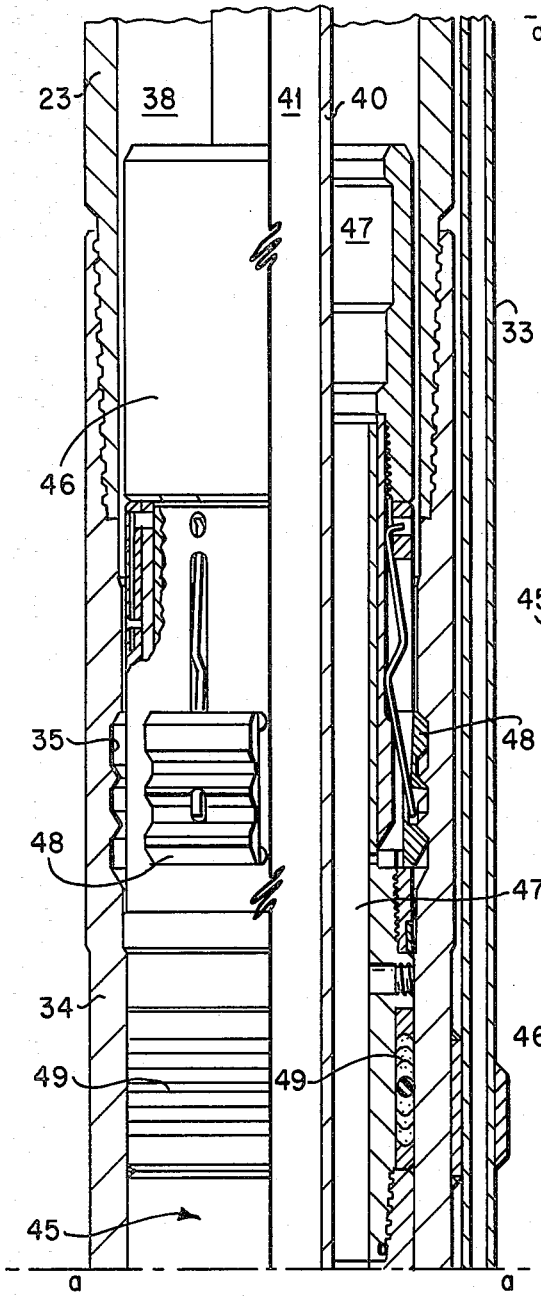
FIGS. 4A–D are drawings partially in section and partially in elevation which show the safety valve of FIGS. 2A–D returned to its first position after the work string has been partially withdrawn from the longitudinal flow passageway which extends through the safety valve.
Figure 4B:
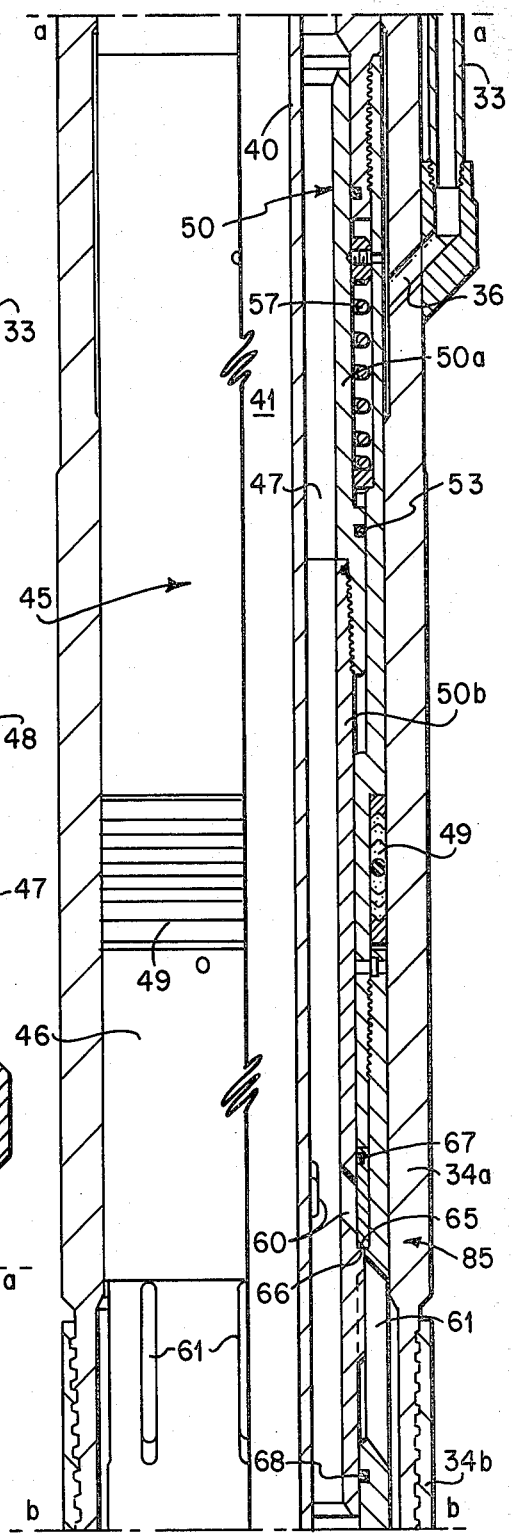
Figure 4C:
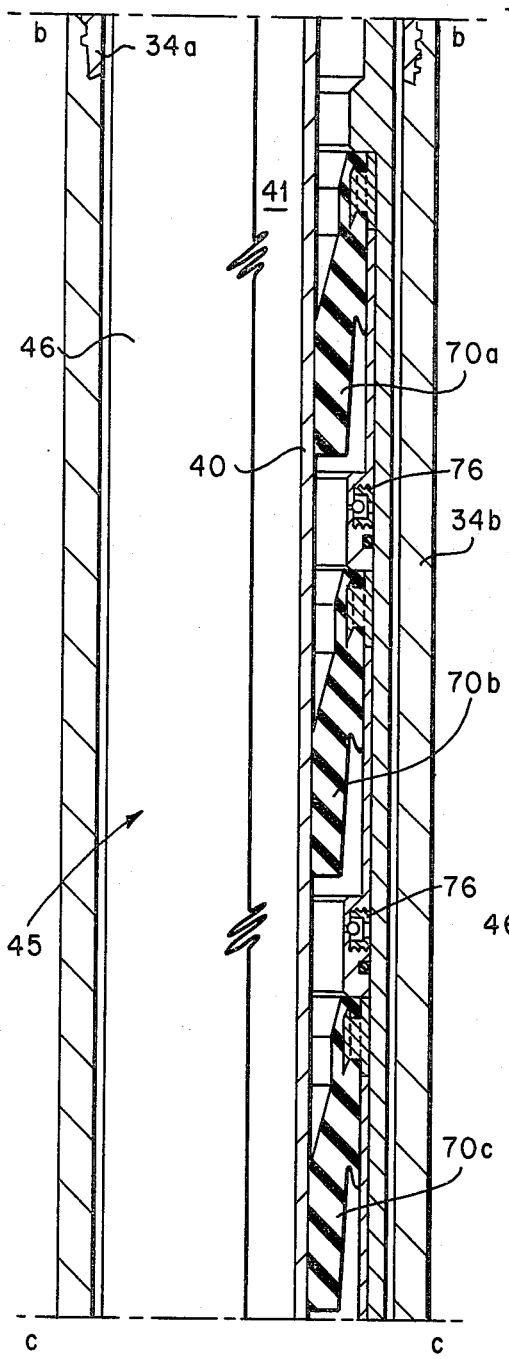
Figure 4D:
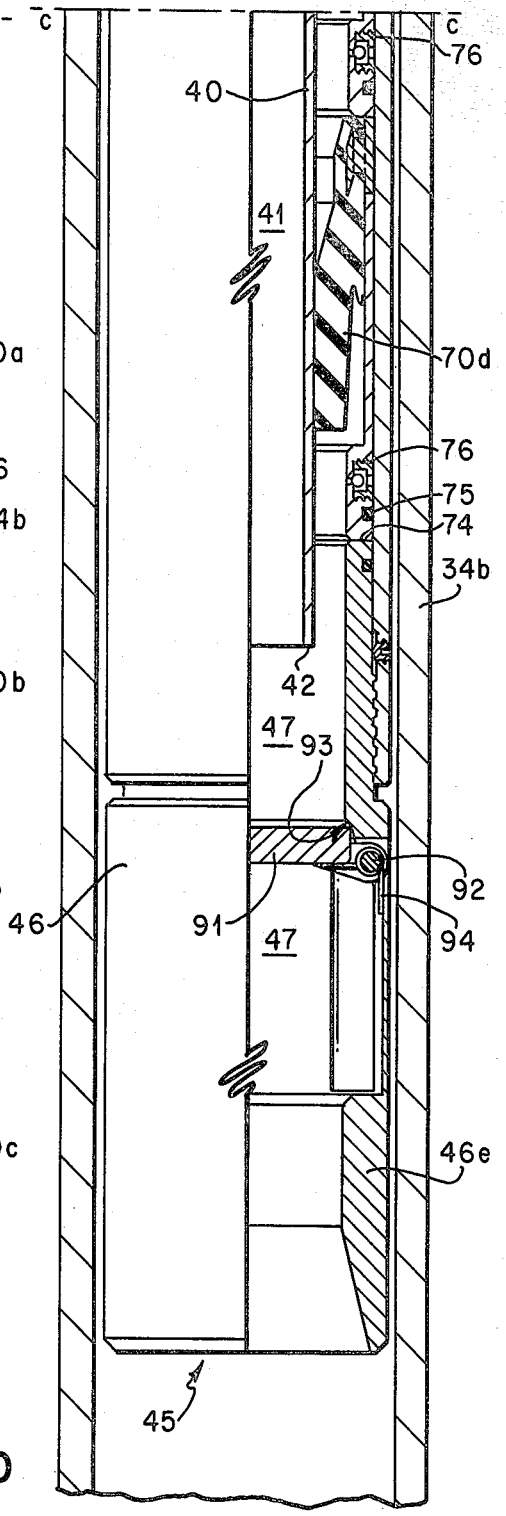
Figure 5:
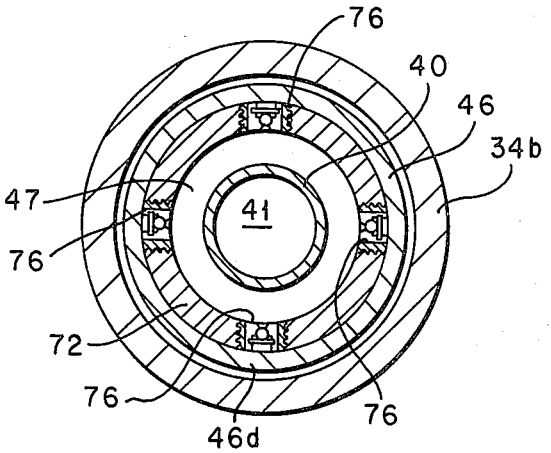
FIG. 5 is a cross-sectional view taken along line 5—5 of FIG. 3D and shows the pressure regulating means which limits the maximum difference in pressure acting upon each sealing element.

Each retaining cylinder 72 carries an o-ring 75 on its outside diameter to prevent undesired fluid flow between the exterior of cylinder 72 and the inside diameter of housing means subassembly 46*d*. A plurality of pressure regulating valves 76 is also carried by each retaining cylinder 72. Regulating valves 76 are spring load ball check valves which open to allow fluid flow therethrough when the difference in pressure across each regulating valve 76 exceeds a preselected value. Various relief valves are commercially available and could be used in place of the ball check valves shown in the drawings. Contact between second flow conductor 40 and sealing elements 70*a–d* forms a plurality of longitudinally spaced fluid chambers 80, 81 and 82 as shown in FIGS. 3C and 3D. If the difference in fluid pressure between adjoining chambers 80, 81, and 82 exceeds a preselected value as compared to each other or longitudinal flow passageway 47, pressure regulating valves 76 will open to reduce the pressure difference to within the preselected value. Thus, the pressure rating for sealing elements 70*a–d* is not exceeded, and their effectiveness is significantly increased. U.S. Pat. No. 3,215,203 discloses a similar system of sealing elements and regulating valves for forming a fluid barrier with a flow conductor.

Flapper valve means 90 is threadedly attached to the extreme end of housing means 46 opposite from locking mandrel 46*a*. Flapper valve means 90 includes cylindrical housing means subassembly 46*e* with longitudinal flow passageway 47 extending therethrough. Circular valve disc 91 is secured by hinge 92 to housing means subassembly 46*e* within passageway 47. Third annular valve seat 93 is formed on the inside diameter of subassembly 46*e* facing valve disc 91. Resilient means or spring 94 biases disc 91 to contact third annular valve seat 93. Fluid flow in an upward direction within passageway 47 also encourages disc 91 to contact seat 93.

Extreme end 41 of work string 40 can contact disc 91 to swing it out of the way, opening longitudinal flow passageway 47. Preferably, any difference in fluid pressure across disc 91 should be equalized prior to contact with work string 40 to prevent damage to hinge 92. Fluid pressures can be equalized by pumping down tubing string 23 from the well surface or by opening poppet valve means 85 to allow fluid flow through radial openings 60 and 61. Poppet valve means 85 allows fluid flow to bypass elastomeric elements 70*a–d*.

Operating Sequence

A typical service performed by hydraulic snubbing apparatus 20 is to insert work string 40 into bore 38 of tubing string 23 against well pressure to remove or wash out a sand bridge which may be restricting formation fluid flow through bore 38. A sand bridge can be removed by pumping high pressure clean fluids from the well surface down through bore 41 of work string 40 to lift the sand or other particulate matter to the well surface through the annulus between the exterior of work string 40 and the interior of production tubing string 23.

Surface blowout preventers 26, 27, and 28 are designed to shut off undesired fluid flow from either tubing string 23 or work string 40 during emergency conditions. Safety valve 45 functions as a downhole blowout preventer if surface blowout preventers 26, 27, and 28 should fail to operate properly. During normal operating conditions, safety valve 45 must allow fluid communication through both bore 41 or work string 40 and the annulus between work string 40 and tubing string 23. Radial openings 60 and 61 of poppet valve means 85 provide the latter fluid communication path.

Safety valve 45 is preferably anchored within landing nipple 34 by conventional wireline techniques prior to attaching snubbing unit 20. A removable prong (not shown) can be used to hold disc 91 away from third annular valve seat 93 to equalize fluid pressures during installation of safety valve 45. After the prong has been removed and with no control fluid pressure present in chamber 54, safety valve 45 will be in its second position blocking fluid flow through tubing string 23. After installing snubbing unit 20, control fluid pressure can be applied from the well surface to chamber 54 to open poppet valve means 85. Fluid communication through radial openings 60 and 61 will then equalize fluid pressure across disc 91.

Work string 40 can be inserted through tubing 23 and longitudinal flow passageway 47 by conventional snubbing techniques. End 42 of work string 40 will contact disc 91 to swing it away from valve seat 93. Elastomeric sealing elements 70*a–d* form a fluid barrier with the exterior of work string 40 when it is disposed within longitudinal flow passageway 47. When necessary, fluids can bypass sealing elements 70*a–d* by opening poppet valve means 85.

During an emergency condition, control fluid pressure within chamber 54 can be decreased below a preselected value to allow spring 57 to close poppet valve means 85. Elastomeric sealing elements 70*a–d* cooperate with poppet valve means 85 to block fluid flow through the annulus between work string 40 and tubing string 23. By raising work string 40 with snubbing unit 20 until end 42 is above disc 91, flapper valve means 90 will also be closed. Spring 94 and well fluid pressure cooperate to urge valve disc 91 to contact third annular valve seat 93. Thus, decreasing control fluid pressure and raising work string 23 will shift safety valve 45 from its first position allowing fluid flow therethrough to its second position blocking fluid flow through tubing string 23. In this manner, safety valve 45 provides a secondary barrier or additional backup for surface blowout preventers 26, 27, and 28.

The previous description is illustrative of only one embodiment of the present invention. Those skilled in the art will readily see other variations and modifications without departing from the scope of the invention which is defined by the claims.

What is claimed is:

1. A safety valve for controlling fluid flow through a first flow conductor, comprising:

a. housing means with a longitudinal flow passageway extending therethrough;

b. a valve closure means having a first position allowing fluid flow through the first flow conductor and a second position blocking fluid flow through the first flow conductor;

c. means for shifting the valve closure means between its first position and its second position in response to control fluid pressure from the well surface;

d. sealing means for forming a fluid barrier with the exterior of a second flow conductor when the second flow conductor is disposed within the longitudinal flow passageway; and e. the valve closure means further comprising a poppet valve means which can be opened and closed in response to control fluid pressure from the well surface; and a flapper valve means which can be opened by extending the second flow conductor through the longitudinal passageway.

2. A safety valve as defined in claim 1, further comprising:

a. an operating sleeve slidably disposed within the longitudinal flow passageway;

b. a piston, on the exterior of the operating sleeve, comprising a portion of the means for shifting the valve closure means;

c. a plurality of radial openings extending through the operating sleeve and the housing means;

d. a first annular valve seat formed on the exterior of the operating sleeve adjacent to its radial openings;

e. a second annular valve seat formed on the interior of the housing means adjacent to its radial openings and sized to engage the first annular valve seat;

f. the first and second annular valve seats comprising a portion of the poppet valve means; and g. engagement of the first and second annular valve seats blocking fluid flow through the radial openings.

3. A safety valve as defined in claim 2, wherein the sealing means comprises:

a. a plurality of sealing elements disposed within the longitudinal passageway between the poppet valve means and the flapper valve means and spaced longitudinally from each other;

b. the sealing elements being engageable with the exterior of the second flow conductor when the second flow conductor is disposed within the longitudinal passageway and forming a fluid barrier therewith when the second flow conductor is both moving and stationary with respect to the housing means;

c. a plurality of longitudinally spaced chambers formed by the engagement between the sealing elements and the exterior of the second flow conductor; and d. pressure regulating means for limiting the pressure differential between each chamber to below a preselected value.

4. A safety valve as defined in claim 3, wherein the flapper valve means comprises;

a. a third annular valve seat formed within the longitudinal passageway near the end of the housing means opposite from the locking mandrel;

b. a valve disc hinged within the longitudinal passageway adjacent to the third annular valve seat;

c. means for biasing the disc to engage the third annular valve seat to block fluid flow; and d. the hinge allowing the disc to swing away from the third annular valve seat when contacted by extending the second flow conductor through the longitudinal passageway.

5. A safety valve as defined in claim 4, wherein the first position of the valve closure means consists of:

a. the first and second annular valve seats being spaced longitudinally away from each other to allow fluid flow from the exterior of the housing means through the radial openings into the longitudinal passageway; and b. the second flow conductor extending through the longitudinal passageway to open the flapper valve means.

6. A safety valve as defined in claim 5, comprising means for biasing the operating sleeve to slide longitudinally to engage the first and second annular valve seats.

7. A well tool which can be positioned at a preselected downhole location within a first flow conductor to prevent the undesired escape of well fluids when a second flow conductor is disposed within the first flow conductor, comprising:

a. housing means with a longitudinal flow passageway extending therethrough and sized to receive a second flow conductor therein;

b. a valve closure means having a first position allowing fluid flow through the first flow conductor and a second position blocking fluid flow through the first flow conductor;

c. means for shifting the valve closure means between its first position and its second position in response to control fluid pressure from the well surface;

d. means for releasably anchoring the well tool within the first flow conductor;

e. the valve closure means comprising a poppet valve means for controlling fluid communication with the longitudinal passageway via radial openings through the exterior of the housing means intermediate the ends thereof and a flapper valve means within the longitudinal passageway for blocking fluid flow therethrough;

f. a hydraulic piston and operating sleeve for opening and closing the poppet valve means;

g. a plurality of sealing elements disposed within the longitudinal passageway between the poppet valve means and the flapper valve means and spaced longitudinally from each other;

h. the sealing elements being engageable with the exterior of the second flow conductor when disposed within the longitudinal flow passageway; and i. the flapper valve means being hinged to allow the second flow conductor to be moved longitudinally through the well tool.

8. A well tool as defined in claim 7, wherein hydraulic control fluid can be directed from the well surface to the piston to open the poppet valve means.

9. A well tool as defined in claim 8, wherein the flapper valve means closes when the second flow conductor is withdrawn from the longitudinal passageway.

10. A well tool as defined in claim 9, wherein the poppet valve means in its open position allows fluids to bypass the fluid barrier formed by the sealing elements and the exterior of the second flow conductor.

11. The method of preventing undesired escape of well fluids from a first well flow conductor while moving a second well flow conductor into or out of the first well flow conductor, comprising:

a. releasably anchoring at a preselected downhole location a well tool having housing means with a longitudinal flow passageway extending therethrough, a valve closure means having a first position allowing fluid flow through the first flow conductor and a second position blocking fluid flow through the first flow conductor, means for shifting the valve closure means between its first position and its second position in response to control fluid pressure from the well surface, and sealing means for forming a fluid barrier with the exterior of a second flow conductor when the second flow conductor is disposed within the longitudinal flow passageway, and the valve closure means having a poppet valve means and a flapper valve means;

b. opening the poppet valve means by applying control fluid pressure from the well surface to equalize fluid pressure across the flapper valve means;

c. inserting the second well flow conductor into the first flow conductor at the well surface;

d. moving the second flow conductor longitudinally through the first flow conductor until the second flow conductor opens the flapper valve means;

e. decreasing the control fluid pressure at the well surface to below a preselected value to close the poppet valve means if undesired fluid flow should occur in the annulus between the first and second flow conductor above the well tool; and f. withdrawing the second flow conductor from the longitudinal passageway to close the flapper valve means if undesired fluid flow should occur through the second flow conductor.

12. The method of claim 11 which further comprises energizing the sealing means to firmly engage the exterior of the second flow conductor by closing the poppet valve means.

13. The method of claim 11 which further comprises:

a. using blowout preventers at the well surface as the primary barrier for preventing undesired well fluid flow; and shifting the valve closure means to its second position to establish a secondary barrier for preventing undesired well fluid flow.

14. The method of preventing the undesired escape of well fluids from a first well flow conductor when a second well flow conductor is slidably disposed within the first flow conductor, comprising;

a. releasably anchoring, at a preselected downhole location within the first flow conductor, a well tool having housing means with a longitudinal flow passageway extending therethrough, a valve closure means having a first position allowing fluid flow through the first flow conductor and a second position blocking fluid flow through the first flow conductor, means for shifting the valve closure means between its first position and its second position, and sealing means carried by the housing means within the longitudinal flow passageway;

b. shifting the valve closure means to its first position by applying control fluid pressure from the well surface;

c. inserting the second flow conductor into the first flow conductor at the well surface and sliding the second flow conductor longitudinally through the first flow conductor until the sealing means forms a fluid barrier with the exterior of the second flow conductor disposed within the longitudinal flow passageway; and d. decreasing the control fluid pressure at the well surface to below a preselected value to shift the valve closure means to its second position if undesired fluid flow should occur in the annulus between the first and second flow conductor above the well tool.

* * * * *